US010428585B2

(12) United States Patent
Scott et al.

(10) Patent No.: US 10,428,585 B2
(45) Date of Patent: Oct. 1, 2019

(54) METHODS OF FABRICATING CUTTING ELEMENTS FOR EARTH-BORING TOOLS AND METHODS OF SELECTIVELY REMOVING A PORTION OF A CUTTING ELEMENT OF AN EARTH-BORING TOOL

(71) Applicant: Baker Hughes, a GE company, LLC, Houston, TX (US)

(72) Inventors: Danny E. Scott, Montgomery, TX (US); Timothy K. Marvel, The Woodlands, TX (US); Yavuz Kadioglu, Spring, TX (US); Michael R. Wells, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 35 days.

(21) Appl. No.: 15/726,025

(22) Filed: Oct. 5, 2017

(65) Prior Publication Data

US 2018/0044992 A1 Feb. 15, 2018

Related U.S. Application Data

(62) Division of application No. 14/461,100, filed on Aug. 15, 2014, now Pat. No. 9,797,200, which is a division (Continued)

(51) Int. Cl.
*E21B 10/00* (2006.01)
*E21B 10/567* (2006.01)

(Continued)

(52) U.S. Cl.
CPC ..... *E21B 10/00* (2013.01); *B24D 18/00* (2013.01); *B24D 99/005* (2013.01); *E21B 7/00* (2013.01);

(Continued)

(58) Field of Classification Search
None
See application file for complete search history.

(56) References Cited

U.S. PATENT DOCUMENTS 4,128,136 A 12/1978 Generoux
4,255,165 A 3/1981 Dennis et al.

(Continued)

FOREIGN PATENT DOCUMENTS

CN 5172778 Y 12/1992
CN 201314198 Y 9/2009

(Continued)

OTHER PUBLICATIONS

Canadian Office Action for Canadian Application No. 2,839,694, dated Jan. 28, 2015, 4 pages.

(Continued)

*Primary Examiner* — Colleen P Dunn
*Assistant Examiner* — Ross J Christie
(74) *Attorney, Agent, or Firm* — TraskBritt

(57) ABSTRACT

Cutting elements for use with earth-boring tools include a cutting table having at least two sections where a boundary between the at least two sections is at least partially defined by a discontinuity formed in the cutting table. Earth-boring tools including a tool body and a plurality of cutting elements carried by the tool body. The cutting elements include a cutting table secured to a substrate. The cutting table includes a plurality of adjacent sections, each having a discrete cutting edge where at least one section is configured to be selectively detached from the substrate in order to substantially expose a cutting edge of an adjacent section. Methods for fabricating cutting elements for use with an earth-boring tool including forming a cutting table comprising a plurality of adjacent sections.

20 Claims, 7 Drawing Sheets

Related U.S. Application Data of application No. 13/165,145, filed on Jun. 21, 2011, now Pat. No. 8,807,247.

(51) Int. Cl.

| | |
|---|---|
| ***E21B 10/573*** | (2006.01) |
| ***B24D 18/00*** | (2006.01) |
| ***B24D 99/00*** | (2010.01) |
| ***E21B 7/00*** | (2006.01) |

(52) U.S. Cl.

CPC ..... *E21B 10/567* (2013.01); *E21B 10/5673* (2013.01); *E21B 10/5676* (2013.01); *E21B 10/5735* (2013.01)

(56) References Cited

U.S. PATENT DOCUMENTS

| | | | |
|---|---|---|---|
| 4,592,433 | A | 6/1986 | Dennis |
| 4,676,124 | A | 9/1987 | Fischer |
| 4,694,918 | A | 9/1987 | Hall |
| 4,718,505 | A | 1/1988 | Fuller |
| 4,726,718 | A | 2/1988 | Meskin et al. |
| 4,828,436 | A | 5/1989 | Briese |
| 4,850,523 | A | 7/1989 | Slutz |
| 4,883,132 | A | 11/1989 | Tibbitts |
| 4,898,252 | A | 2/1990 | Barr |
| 4,913,247 | A | 4/1990 | Jones |
| 4,919,220 | A | 4/1990 | Fuller et al. |
| 4,984,642 | A | 1/1991 | Renard et al. |
| 4,987,800 | A | 1/1991 | Gasan et al. |
| 4,991,670 | A | 2/1991 | Fuller et al. |
| 5,025,873 | A | 6/1991 | Cerkovnik |
| 5,028,177 | A | 7/1991 | Meskin et al. |
| 5,030,276 | A | 7/1991 | Sung et al. |
| 5,049,164 | A | 9/1991 | Horton et al. |
| 5,054,246 | A | 10/1991 | Phaal et al. |
| 5,115,873 | A | 5/1992 | Pastusek |
| 5,116,568 | A | 5/1992 | Sung et al. |
| 5,119,714 | A | 6/1992 | Scott et al. |
| 5,135,061 | A | 8/1992 | Newton, Jr. |
| 5,147,001 | A | 9/1992 | Chow et al. |
| 5,172,778 | A | 12/1992 | Tibbitts et al. |
| 5,199,832 | A | 4/1993 | Meskin et al. |
| 5,205,684 | A | 4/1993 | Meskin et al. |
| 5,217,081 | A | 6/1993 | Waldenstrom et al. |
| 5,238,074 | A | 8/1993 | Tibbitts et al. |
| 5,282,513 | A | 2/1994 | Jones |
| 5,351,772 | A | 10/1994 | Smith |
| 5,377,773 | A | 1/1995 | Tibbitts |
| 5,435,403 | A | 7/1995 | Tibbitts |
| 5,437,343 | A | 8/1995 | Cooley et al. |
| 5,447,208 | A | 9/1995 | Lund et al. |
| 5,469,927 | A | 11/1995 | Griffin |
| 5,499,688 | A | 3/1996 | Dennis |
| 5,667,028 | A | 9/1997 | Truax et al. |
| 5,706,906 | A | 1/1998 | Jurewicz et al. |
| 5,720,357 | A | 2/1998 | Fuller et al. |
| 5,740,874 | A | 4/1998 | Matthias |
| 5,755,299 | A | 5/1998 | Langford, Jr. et al. |
| 5,871,060 | A | 2/1999 | Jensen et al. |
| 5,881,830 | A | 3/1999 | Cooley |
| 5,924,501 | A | 7/1999 | Tibbitts |
| 5,967,249 | A | 10/1999 | Butcher |
| 5,975,811 | A | 11/1999 | Briese |
| 5,979,571 | A | 11/1999 | Scott et al. |
| 5,979,578 | A | 11/1999 | Packer |
| 5,979,579 | A | 11/1999 | Jurewicz |
| 6,000,483 | A | 12/1999 | Jurewicz et al. |
| 6,003,623 | A | 12/1999 | Miess |
| 6,065,554 | A | 5/2000 | Taylor et al. |
| 6,068,071 | A | 5/2000 | Jurewicz |
| 6,102,140 | A | 8/2000 | Boyce et al. |
| 6,193,001 | B1 | 2/2001 | Eyre et al. |
| 6,202,770 | B1 | 3/2001 | Jurewicz et al. |
| 6,202,771 | B1 | 3/2001 | Scott et al. |
| 6,216,805 | B1 | 4/2001 | Lays et al. |
| 6,220,375 | B1 | 4/2001 | Butcher et al. |
| 6,315,066 | B1 | 11/2001 | Dennis |
| 6,401,844 | B1 | 6/2002 | Doster et al. |
| 6,412,580 | B1 | 7/2002 | Chaves |
| 6,446,740 | B2 | 9/2002 | Eyre |
| 6,458,471 | B2 | 10/2002 | Lavato et al. |
| 6,481,511 | B2 | 11/2002 | Matthias et al. |
| 6,612,383 | B2 | 9/2003 | Desai et al. |
| 6,672,406 | B2 | 1/2004 | Beuershausen |
| 6,739,417 | B2 | 5/2004 | Smith et al. |
| 6,742,611 | B1 | 6/2004 | Illerhaus et al. |
| 6,823,952 | B1 | 11/2004 | Mensa-Wilmot et al. |
| 6,872,356 | B2 | 3/2005 | Butcher et al. |
| 6,935,444 | B2 | 8/2005 | Lund et al. |
| 7,159,487 | B2 | 1/2007 | Mensa-Wilmot et al. |
| 7,188,692 | B2 | 3/2007 | Lund et al. |
| 7,350,601 | B2 | 4/2008 | Belnap et al. |
| 7,377,341 | B2 | 5/2008 | Middlemiss et al. |
| 7,395,882 | B2 | 7/2008 | Oldham et al. |
| 7,462,003 | B2 | 12/2008 | Middlemiss |
| 7,473,287 | B2 | 1/2009 | Belnap et al. |
| 7,493,973 | B2 | 2/2009 | Keshavan et al. |
| 7,594,553 | B2 | 9/2009 | Tank et al. |
| 7,624,818 | B2 | 12/2009 | McClain et al. |
| 7,942,219 | B2 | 5/2011 | Keshavan et al. |
| 7,951,213 | B1 | 5/2011 | Miess et al. |
| 2002/0071729 | A1 | 6/2002 | Middlemiss et al. |
| 2005/0183892 | A1* | 8/2005 | Oldham ..... E21B 7/20 175/402 |
| 2005/0247492 | A1 | 11/2005 | Shen et al. |
| 2005/0263328 | A1 | 12/2005 | Middlemiss |
| 2006/0032677 | A1 | 2/2006 | Azar et al. |
| 2006/0060390 | A1 | 3/2006 | Eyre |
| 2006/0086540 | A1 | 4/2006 | Griffin |
| 2006/0144621 | A1 | 7/2006 | Tank et al. |
| 2006/0162969 | A1 | 7/2006 | Belnap et al. |
| 2006/0191723 | A1 | 8/2006 | Keshavan |
| 2006/0207802 | A1 | 9/2006 | Zhang et al. |
| 2006/0219439 | A1 | 10/2006 | Shen et al. |
| 2006/0254830 | A1 | 11/2006 | Radtke |
| 2006/0266559 | A1 | 11/2006 | Keshavan et al. |
| 2007/0187155 | A1 | 8/2007 | Middlemiss |
| 2007/0235230 | A1 | 10/2007 | Cuillier et al. |
| 2007/0284152 | A1 | 12/2007 | Eyre et al. |
| 2008/0142267 | A1 | 6/2008 | Griffin et al. |
| 2008/0206576 | A1 | 8/2008 | Qian et al. |
| 2008/0223641 | A1 | 9/2008 | Elson |
| 2008/0308276 | A1 | 12/2008 | Scott |
| 2009/0114628 | A1 | 5/2009 | DiGiovanni |
| 2009/0218146 | A1 | 9/2009 | Fang et al. |
| 2009/0260877 | A1 | 10/2009 | Wirth |
| 2010/0084197 | A1 | 4/2010 | Voronin et al. |
| 2011/0024200 | A1 | 2/2011 | DiGiovanni et al. |
| 2011/0031031 | A1 | 2/2011 | Vempati et al. |
| 2012/0325563 | A1 | 12/2012 | Scott et al. |
| 2014/0353040 | A1 | 12/2014 | Scott et al. |

FOREIGN PATENT DOCUMENTS

| | | | |
|---|---|---|---|
| EP | 0398776 | A1 | 11/1990 |
| GB | 2261894 | A | 6/1993 |
| WO | 20040106693 | A2 | 12/2004 |
| WO | 2007089590 | A2 | 8/2007 |
| WO | 20110019647 | A2 | 2/2011 |

OTHER PUBLICATIONS

China Office action and Search Report for Chinese Application No. 201280030317.9 dated Jun. 9, 2015, 17 pages.

Chinese Office Action for Chinese Application No. 201280030317.9 dated Feb. 26, 2016, 6 pages.

European Supplementary Search Report for Application No. EP 12 80 3470 dated Oct. 13, 2015, 5 pages.

International Preliminary Report on Patentability for International Application No. PCT/US2012/043306 dated Dec. 23, 2013, 6 pages.

(56) References Cited

OTHER PUBLICATIONS

International Search Report for International Application No. PCT/US2012/043306 dated Mar. 18, 2013, 4 pages.
International Written Opinion for International Application No. PCT/US2012/043306 dated Mar. 18, 2013, 5 pages.

* cited by examiner

METHODS OF FABRICATING CUTTING ELEMENTS FOR EARTH-BORING TOOLS AND METHODS OF SELECTIVELY REMOVING A PORTION OF A CUTTING ELEMENT OF AN EARTH-BORING TOOL

CROSS-REFERENCE TO RELATED APPLICATIONS

This application is a divisional of U.S. patent application Ser. No. 14/461,100, filed Aug. 15, 2014, now U.S. Pat. No. 9,797,200, issued Oct. 24, 2017, which is a divisional of U.S. patent application Ser. No. 13/165,145, filed Jun. 21, 2011, now U.S. Pat. No. 8,807,247, issued Aug. 19, 2014, the disclosure of each of which is hereby incorporated herein in its entirety by this reference.

TECHNICAL FIELD

Embodiments of the present disclosure generally relate to cutting elements for use with earth boring tools and, more specifically, to cutting elements comprising an at least partially segmented superabrasive table, to methods for manufacturing such cutting elements, as well as to earth-boring tools that include such cutting elements.

BACKGROUND

Various earth-boring tools such as rotary drill bits (including roller cone bits and fixed-cutter or drag bits), core bits, eccentric bits, bicenter bits, reamers, and mills are commonly used in forming bore holes or wells in earth formations. Such tools often may include one or more cutting elements on a formation-engaging surface thereof for removing formation material as the earth-boring tool is rotated or otherwise moved within the bore hole.

For example, fixed-cutter bits (often referred to as "drag" bits) have a plurality of cutting elements affixed or otherwise secured to a face (i.e., a formation-engaging surface) of a bit body. FIG. 1 illustrates an example of a conventional cutting element 10. The cutting element 10 includes a layer of superabrasive material 12 (which is often referred to as a "table"), such as mutually bound particles of polycrystalline diamond, formed on and bonded to a supporting substrate 14 of a hard material such as cemented tungsten carbide. The table of superabrasive material 12 includes a front cutting surface 16, a rear face (not shown) abutting the supporting substrate 14, and a peripheral surface 18. As also depicted, it is conventional, although not required, that a chamfer 20 be located between the front cutting surface 16 and the peripheral surface 18. During a drilling operation, a portion of a cutting edge, which is at least partially defined by the peripheral portion of the cutting surface 16, is pressed into the formation. As the earth-boring tool moves relative to the formation, the cutting element 10 is dragged across the surface of the formation and the cutting edge of the cutting surface 16 shears away formation material. Such cutting elements 10 are often referred to as "polycrystalline diamond compact" (PDC) cutting elements, or cutters.

During drilling, cutting elements 10 are subjected to high temperatures due to friction between the diamond table and the formation being cut, high axial loads from weight on the weight on bit (WOB), and high impact forces attributable to variations in WOB, formation irregularities and material differences, and vibration. These conditions can result in damage to the layer of superabrasive material 12 (e.g., chipping, spalling). Such damage often occurs at or near the cutting edge of the cutting surface 16 and is caused, at least in part, by the high impact forces that occur during drilling. Damage to the cutting element 10 results in decreased cutting efficiency of the cutting element 10. In severe cases, the entire layer of superabrasive material 12 may separate (i.e., delaminate) from the supporting substrate 14. Furthermore, damage to the cutting element 10 can eventually result in separation of the cutting element 10 from the surface of the earth-boring tool to which it is secured.

BRIEF SUMMARY

In some embodiments, the present disclosure includes a cutting element for use with an earth-boring tool including a cutting table having a cutting surface. The cutting table includes at least two sections, wherein a boundary between the at least two sections is at least partially defined by a discontinuity formed in the cutting table and extending across the cutting table from a first portion of a peripheral edge of the cutting table to a second, opposing portion of the peripheral edge of the cutting table.

In additional embodiments, the present disclosure includes an earth-boring tool including a tool body and a plurality of cutting elements carried by the tool body. Each cutting element includes a substrate and a cutting table secured to the substrate and having a plurality of mutually adjacent sections. Each section includes a discrete cutting edge, wherein at least one section of the plurality of mutually adjacent sections is configured to be selectively detached from the substrate in order to substantially expose a cutting edge of an adjacent section of the plurality of mutually adjacent sections.

Further embodiments of the present disclosure include a method for fabricating a cutting element for use with an earth-boring tool including forming a cutting table comprising a plurality of adjacent sections comprising forming a plurality of recesses in the cutting table extending along a cutting surface of the cutting table, and forming a discrete cutting edge on each section of the plurality of adjacent sections of the cutting table.

BRIEF DESCRIPTION OF THE DRAWINGS

While the specification concludes with claims particularly pointing out and distinctly claiming that which are regarded as embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular material, apparatus, system, method, or components thereof, but are merely idealized representations, which are employed to describe the present disclosure. Additionally, elements common between figures may retain the same numerical designation.

Embodiments of the present disclosure may include a cutting element for use with an earth-boring tool including a cutting surface (e.g., a cutting table) that is at least partially segmented. For example, the cutting surface may include two or more portions (e.g., sections) at least partially separated by a discontinuity formed in or proximate to the cutting surface.

Figure 1:
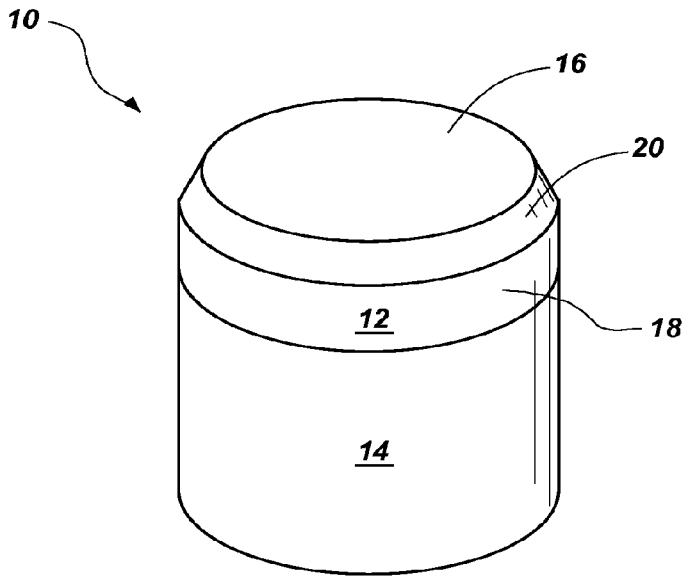
FIG. 1 illustrates a conventional superabrasive cutting element.
Figure 2:
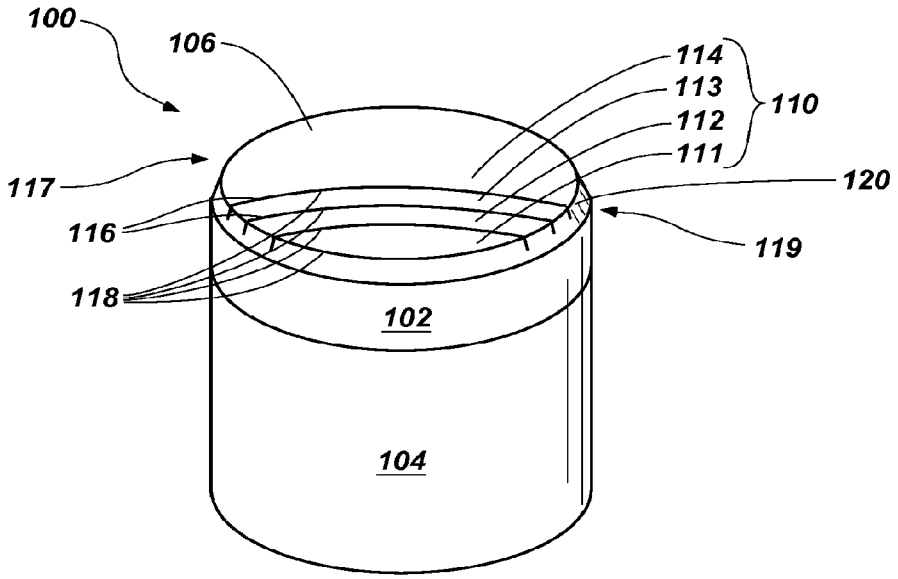
FIG. 2 is an isometric view of a superabrasive cutting element in accordance with an embodiment of the present disclosure.

As shown in FIG. 2, a cutting element 100 may include a cutting surface such as, for example, a layer of superabrasive material forming a cutting table 102 that is disposed over (e.g., on) a substrate 104. It is noted that while the embodiment of FIG. 2 illustrates the cutting table 102 of the cutting element 100 as a cylindrical or disc-shaped, in other embodiments, the cutting table 102 may have any desirable shape, such as a dome, cone, chisel, etc. Furthermore, as discussed below in further detail, in other embodiments, the body of the cutting element 100 (e.g., the cutting table 102 and the substrate 104) may comprise an elongated structure such as, for example, an oval shape, an elliptical shape, a tombstone shape (e.g., an elongated shape having one arced end and another, opposing substantially linear end such as that shown and described with reference to FIG. 2), etc. It is also noted that while the embodiment of FIG. 2 illustrates the cutting table 102 on the supporting substrate 104, in other embodiments, the cutting table 102 may be formed as a freestanding structure.

In some embodiments, the cutting table 102 may include a superabrasive material including comprised of randomly oriented, mutually bonded superabrasive particles (e.g., a polycrystalline material such as diamond, cubic boron nitride (CBN), etc.) that are bonded under high temperature, high pressure (HTHP) conditions. For example, a cutting table having a polycrystalline structure may be formed from particles of a hard material such as diamond particles (also known as "grit") mutually bonded in the presence of a catalyst material such as, for example, a cobalt binder or other binder material (e.g., another Group VIII metal, such as nickel or iron, or alloys including these materials, such as Ni/Co, Co/Mn, Co/Ti, Co/Ni/V, Co/Ni, Fe/Co, Fe/Mn, Fe/Ni, Fe/Ni/Cr, Fe/$Si_2$, Ni/Mn, and Ni/Cr) using an HTHP process. In some embodiments, the diamond material from which the polycrystalline structure is formed may comprise natural diamond, synthetic diamond, or mixtures thereof, and include diamond grit of different particle or crystal sizes, as discussed below with reference to FIG. 7.

In some embodiments, the cutting table 102 may comprise a thermally stable PDC, or TSP. For example, a catalyst material used to form the cutting table 102 may be at least partially removed (e.g., by leaching, electrolytic processes, etc.) from at least a portion of the polycrystalline diamond material in the cutting table 102 as discussed below with reference to FIG. 8.

The substrate 104 may comprise a hard material such as, for example, a cemented carbide (e.g., tungsten carbide), or any other material that is suitable for use as a substrate for cutting element 100. The substrate 104 may be attached (e.g., brazed) to an earth-boring tool (e.g., the earth-boring rotary drill bit 850 (FIG. 11)) after fabrication of the cutting element 100. The cutting table 102 may be secured to the substrate 104 during formation of the cutting table 102 therein during the aforementioned HTHP process, or thereafter using a subsequent HTHP process, or an adhesive process (e.g., a brazing process, any suitable adhesive processes utilizing other adhesive materials, etc.). In some embodiments, the substrate 104 may comprise a portion of the earth-boring tool, or comprise two components, a first component secured to cutting table 102 during formation thereof, and another, longer substrate extension bonded to the first component, as is conventional.

Referring still to FIG. 2, a portion of the cutting table 102 may be at least partially segmented (e.g., may include two or more sections). For example, the cutting table 102 may have one or more discontinuities formed therein which at least partially define sections 110 of the cutting table 102 (e.g., sections 111, 112, 113, 114). The sections 110 of the cutting table 102 may extend from a first side 117 of the cutting table 102 to a second, opposing side 119 of the cutting table 102 and may, if desired, extend completely around cutting table 102. The sections 110 of the cutting table 102 may comprise sequential or consecutive sections 110 positioned along and, optionally about, a longitudinal axis of the cutting element 100. For example, a first edge of section 111 may comprise a portion of the peripheral edge 120 of the cutting table 102 and a second, opposing edge of section 111 may be positioned adjacent to a first edge of section 112. In a similar manner, a second, opposing edge of section 112 may be positioned adjacent to a first edge of section 113 and so on.

In some embodiments, the one or more discontinuities in the cutting table 102 may comprise one or more recesses 116 (e.g., notches) formed in the cutting table 102 (e.g., at least partially through a cutting surface 106 of the cutting table 102). The recesses 116 may substantially extend across the cutting surface 106 (e.g., a substantially planar cutting surface) of the cutting table 102 from the first side 117 of the cutting table 102 to the second, opposing side 119 of the cutting table 102. For example, the recesses 116 may extend from a portion of the peripheral edge 120 of the cutting table 102 to another portion of the peripheral edge 120.

In some embodiments, the recesses 116 may be formed in the cutting table 102 by removing a portion of the cutting table 102 through processes such as, for example, a laser cutting process, an electric discharge machining (EDM) process, or any other suitable machining or material removal processes. For example, the recesses 116 may be formed in a laser cutting process such as, for example, the processes described in pending U.S. patent application Ser. No. 12/265,462, filed Nov. 5, 2008, which is assigned to the assignee of the present disclosure, and the entire disclosure of which is incorporated herein by this reference. In some embodiments and as described below with reference to FIGS. 3 and 4, the recesses 116 may be formed (e.g., laser cut) into the cutting table 102 to form a chamfer on one or more sides of the cutting table 102 forming the recesses 116. As used herein, the term "chamfer" refers to any surface formed along at least a portion of a peripheral edge of a section of a cutting element and may refer to a single-surface chamfer, a dual-surface chamfer, a triple-surface chamfer, a rounded edge, or any other protective structural configuration for a cutting edge.

In some embodiments, the recesses 116 may be formed (e.g., machined, molded, etc.) in the material forming the cutting table 102 during manufacture of the cutting table 102 (e.g., as in the embodiments described below with reference to FIGS. 9 and 10).

Figure 2A:
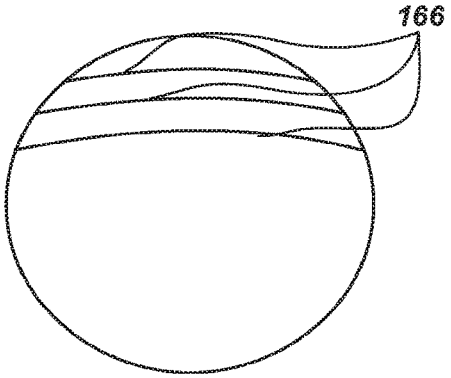
FIGS. 2A through 2D are top views of superabrasive cutting elements in accordance with embodiments of the present disclosure.
Figure 2B:
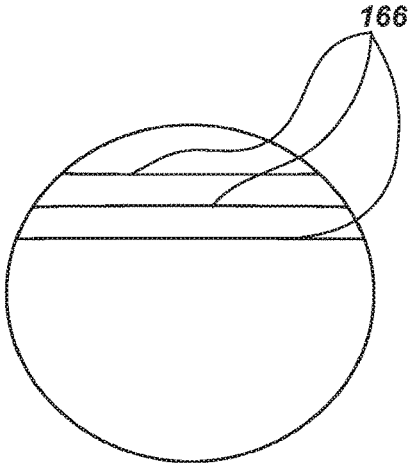
Figure 2C:
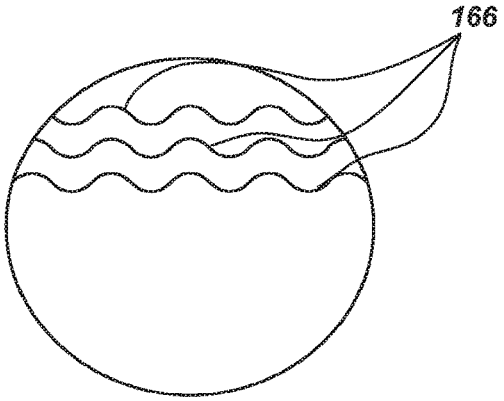
Figure 2D:
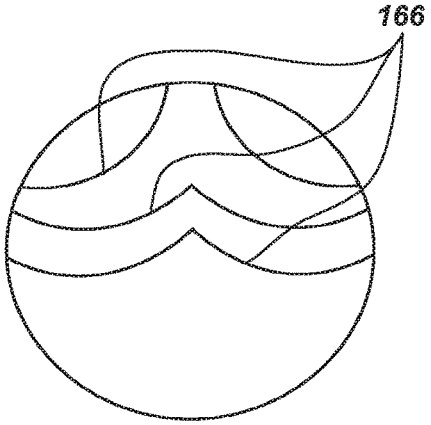

It is noted that while the embodiment of FIG. 2 illustrates the recesses 116 as having a substantially arced shape, the recesses 116 may be formed in any suitable shape. For example, FIGS. 2A through 2D each show a top view of a cutting table 102 of a cutting element 100 having recesses 166 (e.g., cutting table 102 of cutting element 100 having recesses 116 (FIG. 2)) formed in an arc shape (FIG. 2A), a linear shape (FIG. 2B), an undulated shape (FIG. 2C), and yet another arced shape forming a point proximate to a midline of the cutting table (FIG. 2D).

As shown in FIG. 2, the sections 110 of the cutting table 102 may each form a cutting edge (e.g., a discrete cutting edge) of the cutting table 102. For example, each section 110 of the cutting table 102 may comprise a cutting edge (e.g., cutting edges 118). The cutting edges 118 may be substantially similar (e.g., in one or more of shape, orientation, and extent along a portion of the cutting table 102) and may each be offset from one or more adjacent cutting edges 118 along the cutting surface 106 of the cutting table 102.

The cutting edge 118 of each section 110 may be formed and positioned to be exposed at different times during a downhole operation of an earth-boring tool including the cutting element 100 (e.g., during drilling or reaming a bore hole). For example, during a drilling operation, the cutting element 100 may at least partially engage the formation being drilled with the cutting edge 118 of section 110 of the cutting table 102. After the cutting edge 118 of an initial section 110 begins to wear to an undesirable extent from contact with the formation (e.g., due to high temperatures, high loads, and high impact forces experienced during drilling operations), that section 110 may be removed (e.g., detached) from the cutting element 100. For example, portions of the cutting element 100 (e.g., the cutting table 102, the substrate 104, the interface between the cutting table 102 and the substrate 104, or combinations thereof) may be configured such that initial section 110 will detach from the remaining cutting table 102. The recesses 116 may be formed in the cutting table 102 such that after the cutting edge 118 of each section 110 has been subjected to a selected amount of stress (e.g., from being dragged along the formation under the forces and loads applied from rotation of the drill bit under WOB), the interface between that section 110 of the cutting table 102 and the substrate 104 will be weakened enough that the section 110 will detach (e.g., delaminate) from the substrate 104 (or any other surface or element to which the cutting table 102 is attached), exposing the cutting edge 118 of the next, adjacent section 110 to engage the formation being cut.

In some embodiments, the recesses 116 may extend only partially through the cutting table 102. In such an embodiment, the reduced cross-sectional area of the cutting table 102 at the recesses 116 will create a stress concentration due to the forces and loads applied at the cutting edge 118 of the section 110 of the cutting table 102 proximate to the recesses 116 (e.g., at the rotationally trailing end of the section 110 of the cutting table 102) during a drilling operation. Such stress concentrations may enable the cutting table 102 to preferentially fail (e.g., fracture) along the recesses 116, detaching only one section 110 of the cutting table 102 rather than the entire cutting table 102. In other embodiments, the recesses 116 may extend entirely through the cutting table 102, to the substrate 104 and may enable one section 110 of the cutting table 102, while leaving the remaining sections of the cutting table 102 intact.

Detachment of one of the sections 110 of the cutting table 102 (e.g., section 111) from the substrate 104 may then expose an adjacent section 110 of the cutting table 102 (e.g., section 112) at a leading edge of the cutting table 102. The drilling operation may continue with the cutting element 100 engaging the formation being drilled with the cutting edge 118 of section 112 of the cutting table 102. Drilling in a similar manner may continue as each section 110 of the cutting table 102, in turn, provides a cutting edge 118 at a leading portion of the cutting table 102 engaging the formation and then subsequently is removed to expose another section 110 of the cutting table 102. In some embodiments, after one or more sections 110 of the cutting table 102 have been removed, any remaining portions of the substrate 104 that were previously underlying the removed sections 110 may be subsequently worn away in the drilling process through contact with the formation, forming a so-called "wear flat."

It is noted that while the embodiment of FIG. 2 illustrates recesses 116 in the cutting table 102 to enable detachment of sections 110 of the cutting table 102 substantially at predetermined locations of the cutting table 102 (e.g., substantially between sections 110 of the cutting table 102), in other embodiments, the cutting table 102 may include other features to enable detachment of sections 110 of the cutting table 102. For example, a heat source (e.g., a laser) may be applied to the cutting table 102 to heat portions of the cutting table 102 (e.g., to a temperature greater than 750° C.) to form the discontinuities. The heating of the portions of the cutting table 102 may act to graphitize a portion of the diamond crystals forming the cutting table 102, which may substantially at least partially weaken portions of the cutting table 102 forming the discontinuities therein. As the cutting table 102 is subjected to heating during a drilling process, the graphitization of the cutting table 102 may continue at the discontinuities. Such heating may be applied to the cutting table 102 in a separate process or may be applied during the laser cutting of the recesses 116. In some embodiments, portions of the cutting table may have reduced cross-sectional areas due to protrusions formed on the substrate and extending into the cutting table (e.g., as discussed below with reference to FIG. 5) to enable detachment of sections of the cutting table. In some embodiments, portions of the cutting table may be formed from materials (e.g., diamond material) having differing properties such as, for example, particle size (e.g., as discussed below with reference to FIG. 7) to facilitate selective detachment of sections of the cutting table 102. In some embodiments, combinations of the features enabling detachment of sections of the cutting table described herein may be implemented in unison.

Figure 3:
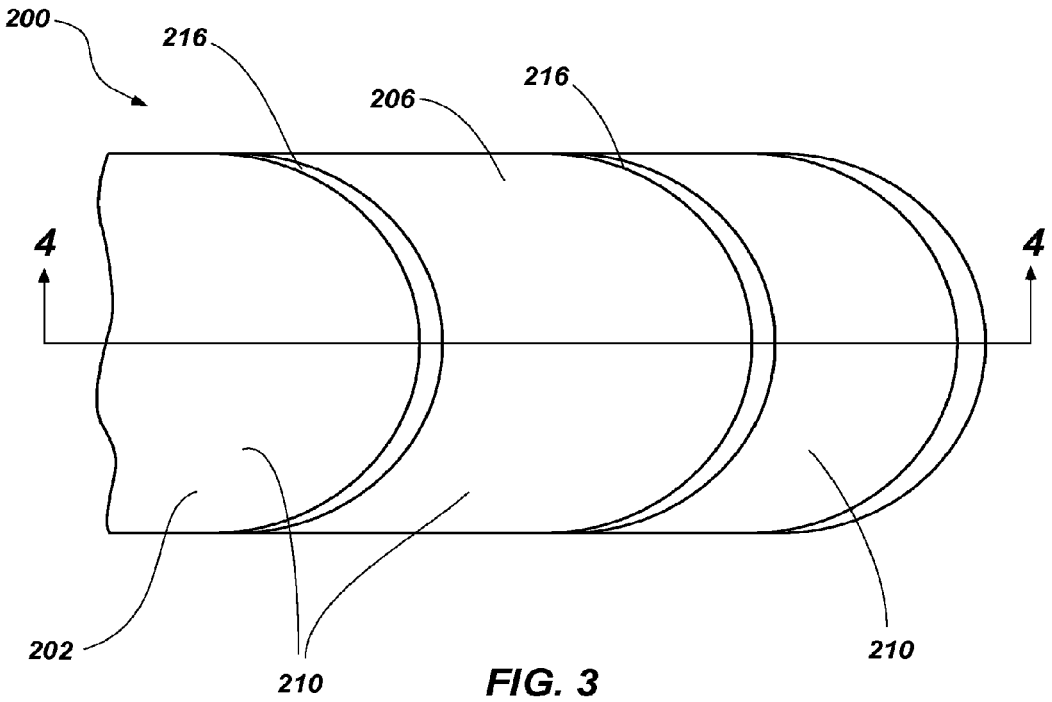
FIG. 3 is a top view of a portion of a superabrasive cutting element in accordance with another embodiment of the present disclosure.
Figure 4:
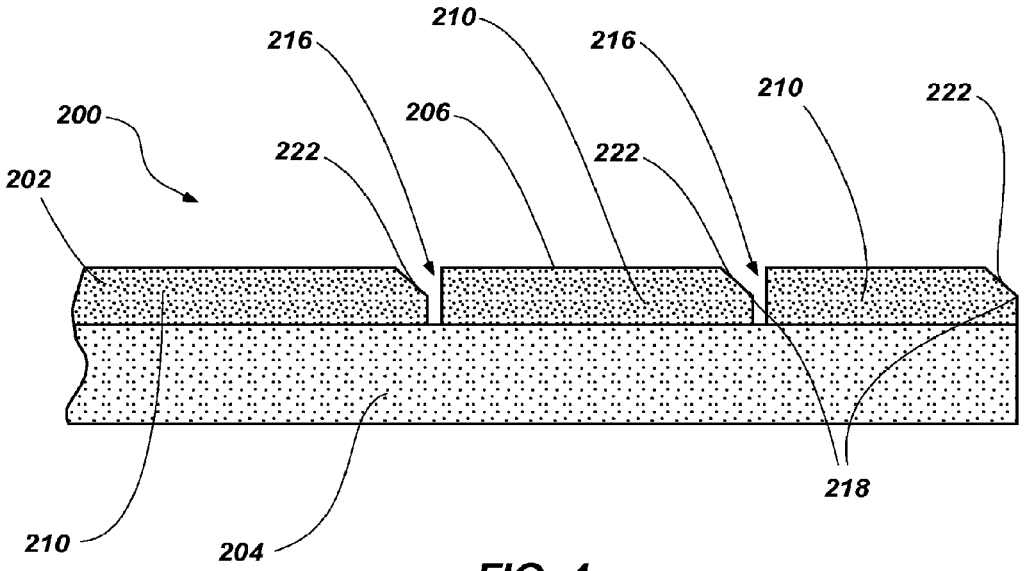
FIG. 4 is a cross-sectional side view of the superabrasive cutting element shown in FIG. 3 taken along section line 4-4.

FIGS. 3 and 4 are a top view and a cross-sectional side view, respectively, of a portion of a cutting element 200 including a sectioned cutting table 202 disposed over a substrate 204 that may be somewhat similar to the cutting element 100 shown and described with reference to FIG. 2. As shown in FIGS. 3 and 4, the cutting element 200 may comprise an elongated shape (e.g., a tombstone shape). The cutting table 202 may include two or more sections 210 separated by recesses 216 in the cutting table 202. The sections 210 may be formed at regular intervals, irregular intervals, or combinations thereof along the cutting surface 206. In some embodiments, portions of the cutting table 202 adjacent the recesses 216 may include a chamfered surface 222. The chamfered surface 222 may be formed on leading portions of the sections 210 (e.g., cutting edges 218) at an oblique angle to the cutting surface 206 of the cutting table 202.

In some embodiments, the recesses 216 and the chamfered surface 222 may be formed in the cutting table 202 after the cutting table 202 has been substantially formed. In some embodiments, the recesses 216 and the chamfered surface 222 may be formed in the cutting table 202 during formation of the cutting table 202 (e.g., as described below with reference to FIGS. 9 and 10).

In some embodiments, and as shown in FIG. 4, the recesses 216 may extend entirely through portions of the cutting table 202 to the substrate 204.

As above, the location and orientation of sections 210 of the cutting table 202 may enable a first section 210 of the cutting table 202 to engage a formation during an initial phase of a drilling operation. The first section 210 of the cutting table 202 may then be detached from the cutting table 202 after it has worn substantially to an expected extent, enabling a second section 210 of the cutting table 202 to engage the formation, and so on.

Figure 5:
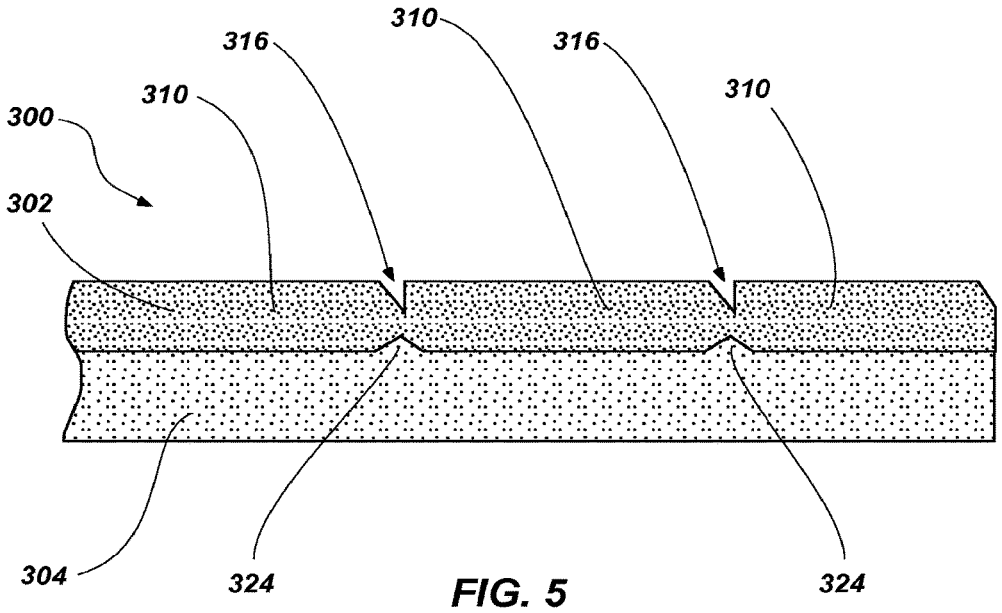
FIG. 5 is a cross-sectional side view of a portion of a superabrasive cutting element in accordance with yet another embodiment of the present disclosure.

FIG. 5 is a cross-sectional side view of a portion of a cutting element 300 including a sectioned cutting table 302 disposed over a substrate 304 that may be somewhat similar to the cutting elements 100, 200 shown and described with reference to FIGS. 2 through 4. As shown in FIG. 5, the substrate 304 may include one or more protrusions 324 extending from the substrate 304 at the interface between the substrate 304 and the cutting table 302. The protrusions 324 may form portions of reduced cross-sectional area of the cutting table 302 in order to at least partially define sections 310 of the cutting table 302. Where implemented together, recesses 316 in the cutting table 302 and the protrusions 324 of the substrate 304 may be positioned to proximate to each other (e.g., substantially coextensive with each other). For example, the recesses 316 may be positioned substantially over in alignment with the protrusions 324. As shown in FIG. 5, in some embodiments, the recesses 316 may not extend entirely through the cutting table 302.

Figure 6:
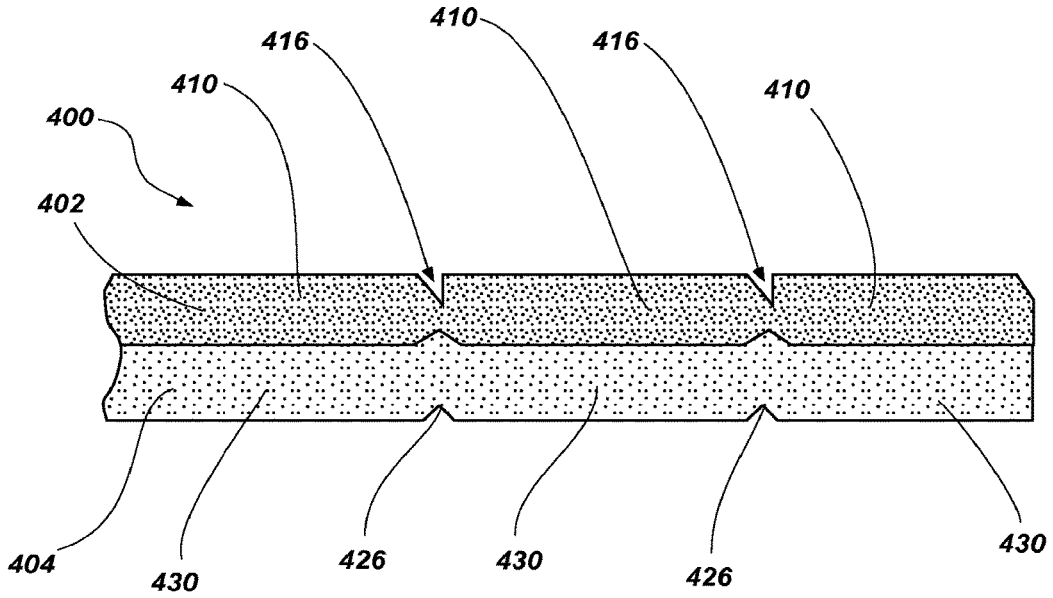
FIG. 6 is a cross-sectional side view of a portion of a superabrasive cutting element in accordance with yet another embodiment of the present disclosure.

FIG. 6 is a cross-sectional side view of a portion of a cutting element 400 including a sectioned cutting table 402 disposed over a substrate 404 that may be somewhat similar to the cutting elements 100, 200, 300 shown and described with reference to FIGS. 2 through 5. As shown in FIG. 6, the substrate 404 may include one or more recesses 426 formed in the substrate 404 at a surface of the substrate 404 distant from (e.g., opposing) the interface between the substrate 404 and the cutting table 402 (e.g., at a surface of the substrate 404 to be secured to an earth-boring tool). The recesses 426 in the substrate 404 may define sections 430 of the substrate 404 that may be similar to the sections 410 of the cutting table 402. The recesses 426 in the substrate 404 may enable the sections 410 of the cutting table 402 and the corresponding sections 430 of the substrate 404 to detach together from an earth-boring tool to which the substrate 404 is secured (e.g., by creating stress concentrations at or proximate the recesses 426 in order to increase the probability of failure of the cutting table 402 and the substrate 404 at or proximate the recesses 416, 426). In some embodiments, the sections 430 of the substrate 404 formed by the recesses 426 may be formed to be substantially coextensive with sections 410 of the cutting table 402. For example, the recesses 426 in the substrate 404 may be formed proximate to (e.g., substantially coextensive with) one or more detachment features of the cutting table 402 (e.g., with recesses 416 in the cutting table 402, protrusions in the substrate 404, or combinations thereof).

Figure 7:
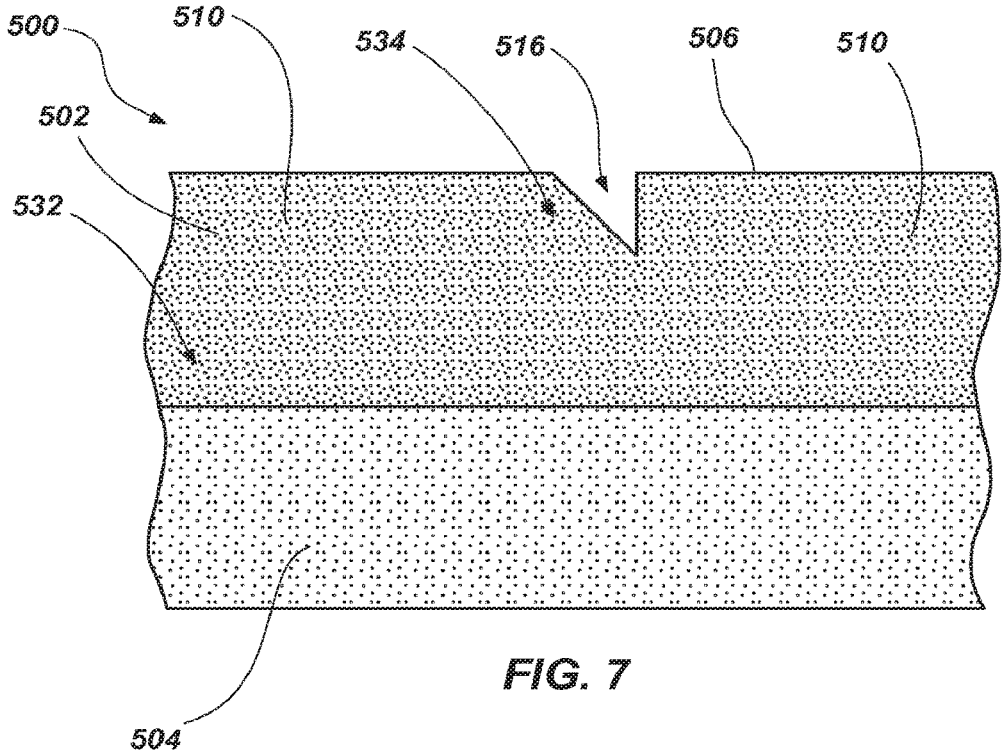
FIG. 7 is a cross-sectional side view of a portion of a superabrasive cutting element in accordance with yet another embodiment of the present disclosure.

FIG. 7 is a cross-sectional side view of a portion of a cutting element 500 including a sectioned cutting table 502 disposed over a substrate 504 that may be somewhat similar to the cutting elements 100, 200, 300, 400 shown and described with reference to FIGS. 2 through 6. As shown in FIG. 7, the cutting table 502 may include a detachment feature formed by variations in the properties of the materials forming the cutting table 502. For example, the cutting table 502 may include one or more portions formed from a material comprising relatively coarser particles (e.g., a diamond material having an average particle size greater than 1.0 mm) while one or more other portions of the cutting table 502 may be formed from a material comprising relatively finer particles (e.g., a diamond material having an average a particle size less than 1.0 mm (e.g., less than 100 microns (μm))). In some embodiments, such variations in the particle size of the material forming the cutting table 502 may be implemented by, for example, forming from multiple layers of material, each layer having a different average particle size, by using a material having a bi-modal or multi-modal particle size distribution, or combinations thereof. In some embodiments, the coarser particles may be positioned in the cutting table 502 at portions of the cutting table 502 configured to be detached from the substrate 504. Stated in another way, a portion of the cutting table 502 formed from the coarser particles may increase the likelihood of detachment of a section 510 of the cutting table 502 from the substrate 504 or fracture of sections 510 of the cutting table 502 as compared to portions of the cutting table 502 formed from relatively finer particles.

The cutting table 502 may include one or more detachment portions comprising materials having relatively coarser particles located proximate to the interface between the substrate 504 and the cutting table 502, proximate to the recesses 516 formed in the cutting table 502 (where implemented), or combinations thereof. For example, portion 532 of the cutting table 502 that is located proximate to the interface between the cutting table 502 and the substrate 504 may be formed from a material comprising relatively coarser particles while portion 534 of the cutting table 502 that is relative more distant from the interface between the cutting table 502 and the substrate 504 (e.g., proximate to a cutting surface 506) may be formed from a material comprising relatively finer particles. In some embodiments and where implemented together, portions of the cutting table 502 proximate to the recesses 516 may be formed from a material comprising relatively coarser particles.

In some embodiments, the portion 532 of the cutting table 502 that is located proximate to interface between the cutting table 502 and the substrate 504 may be formed from a material comprising relatively finer particles while portion 534 of the cutting table 502 that is relative more distant from the interface between the cutting table 502 and the substrate 504 (e.g., proximate to the cutting surface 506 or recesses 516) may be formed from a material comprising relatively coarser particles.

In some embodiments, the material forming the cutting table 502 may be formed as a gradient that gradually transitions from relatively coarser particles to relatively finer particles and vice versa. For example, the material forming the cutting table 502 may be formed from as a gradient having relatively coarser particles at the portion 532 of the cutting table 502 that is located proximate to interface between the cutting table 502 and the substrate 504 that gradually transitions to relatively finer particles at the portion 534 of the cutting table 502 located proximate to the cutting surface 506. In other embodiments, the cutting table 502 may be formed a discrete layer of relatively coarser particles having another discrete layer of relatively finer particles disposed thereover.

Figure 8:
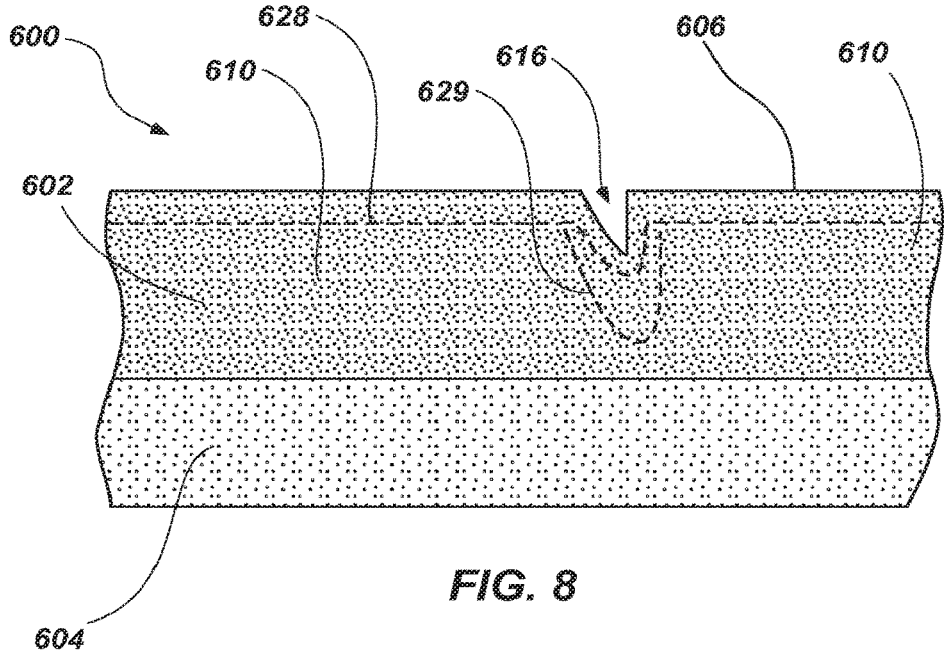
FIG. 8 is a cross-sectional side view of a portion of a superabrasive cutting element in accordance with yet another embodiment of the present disclosure.

FIG. 8 is a cross-sectional side view of a portion of a cutting element 600 including a sectioned cutting table 602 disposed over a substrate 604 that may be somewhat similar to the cutting elements 100, 200, 300, 400, 500 shown and described with reference to FIGS. 2 through 7. As shown in FIG. 8, a portion of the cutting table 602 may have a catalyst material used to form the cutting table 602 at least partially removed therefrom (e.g., by leaching, electrolytic processes, etc.). In some embodiments, the catalyst material may be removed after recesses 616 have been formed in the cutting table 602. For example, where the recesses 616 are formed in an EDM process. Such a process may enable each surface forming the cutting surface 606 (e.g., the sections 610 of the cutting table 602 and the portions of the sections 610 forming the recesses 616) to have the catalyst material removed to a substantially similar depth (e.g., as indicated by dashed line 628) below the surface (e.g., leached to a similar depth). In other embodiments, the cutting table 602 may have the catalyst at least partially removed therefrom before forming the recesses 616.

In some embodiments, the removal of a catalyst from the cutting table 602 may be used to form the discontinuities in the cutting table 602. For example, as shown in FIG. 8, a relatively deeper catalyst removal process (e.g., leaching to a depth extending to or proximate the substrate 604 as indicated by dashed line 629) may be performed at one or more select locations to weaken the cutting table 602 (e.g., through embrittlement) at the select locations. Such a process may be used to form discontinuities with or without the use of the recesses 616. In some embodiments, the cutting table 602 may be subjected to a catalyst removal process to improve the thermal stability thereof and then select locations may be subjected to the relatively deeper catalyst removal process to form the discontinuities.

Figure 9:
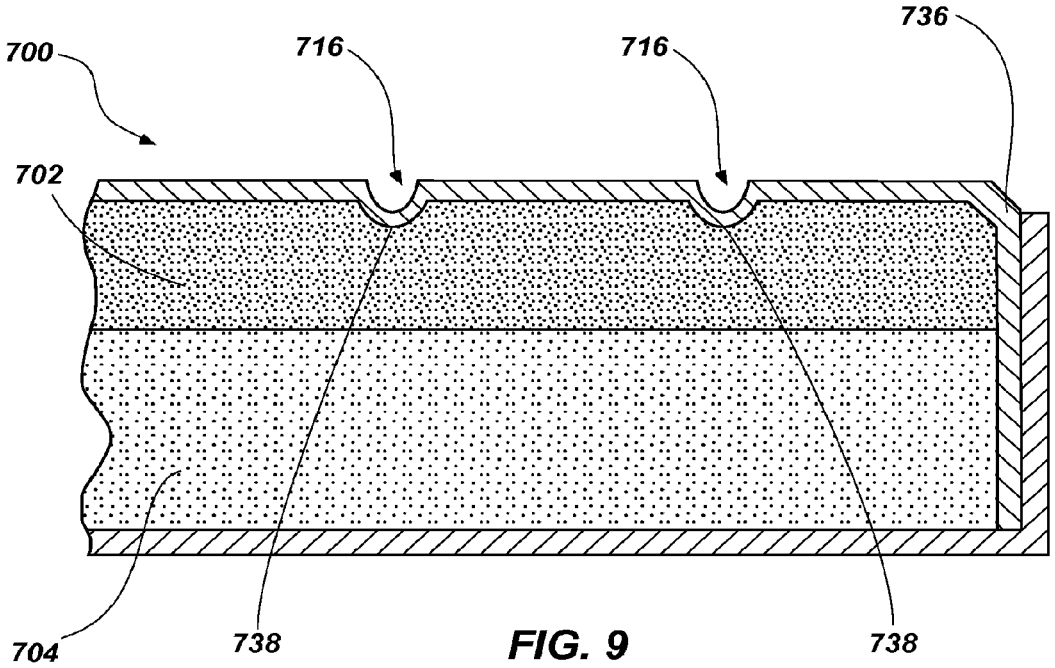
FIG. 9 is a cross-sectional side view of a portion of a superabrasive cutting element illustrating a method of forming a cutting element in accordance with an embodiment of the present disclosure.

FIG. 9 is a cross-sectional side view of a portion of a cutting element illustrating a method of forming a cutting element (e.g., cutting elements 100, 200, 300, 400, 500, 600 shown and described with reference to FIGS. 2 through 8). As shown in FIG. 9, cutting element 700 may be formed in a mold assembly 736 (e.g., a mold assembly comprising a refractory metal). For example, a cutting table 702 may be formed from a plurality of particles (e.g., diamond particles, cubic boron nitride (CBN)) particles, etc.) disposed over a substrate 704 through a high temperature, high pressure (HTHP) process. The mold assembly 736 may include one or more protrusions 738 configured to form recesses 716 in the cutting table 702 during formation of the cutting table 702.

Figure 10:
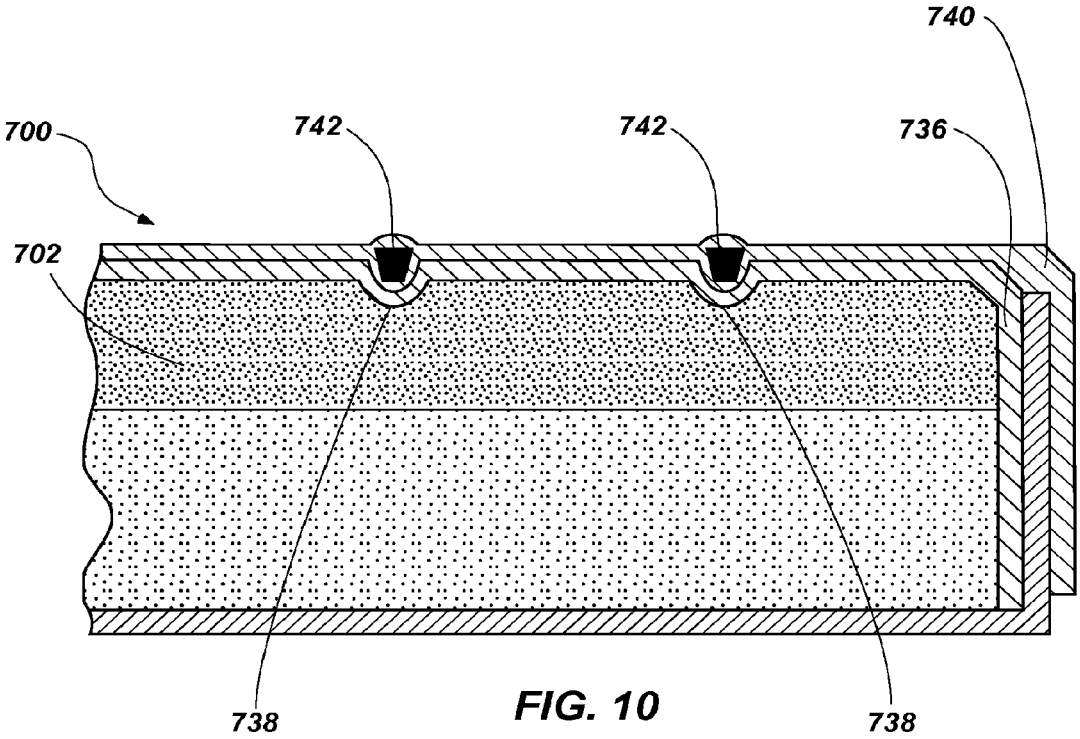
FIG. 10 is a cross-sectional side view of a portion of a superabrasive cutting element illustrating a method of forming a superabrasive cutting element in accordance with another embodiment of the present disclosure.

FIG. 10 is a cross-sectional side view of a portion of a cutting element illustrating a method of forming the cutting element (e.g., cutting elements 100, 200, 300, 400, 500, 600 shown and described with reference to FIGS. 2 through 8). As shown in FIG. 10, the mold assembly 736 may include an additional portion 740 configured to secure a supporting structure (e.g., rods 742) at least partially within the one or more protrusions 738 at a surface opposite to the interface between the mold assembly 736 and the cutting table 702. Such a configuration may act to reinforce the protrusions 738 of the mold assembly 736 as the mold assembly 736 is subjected to a process (e.g., a HTHP process) during formation of the cutting table 702.

Figure 11:
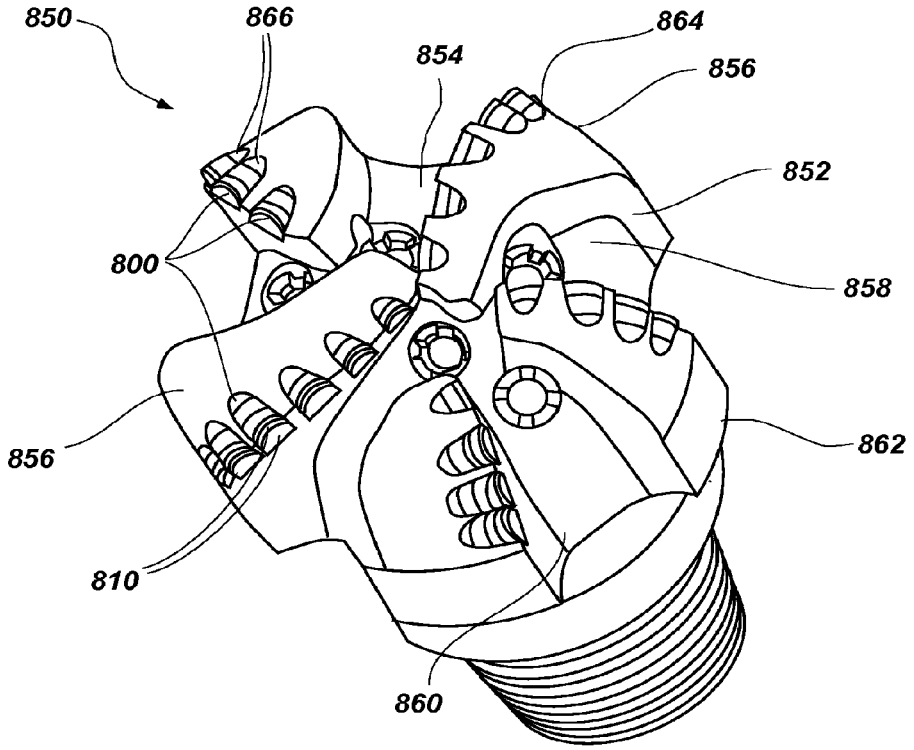
FIG. 11 is an isometric view of an earth-boring tool carrying a plurality of superabrasive cutting elements in accordance with another embodiment of the present disclosure.

FIG. 11 is an embodiment of an earth-boring tool (e.g., a fixed-cutter drill bit 850 (often referred to as a "drag" bit)) including a plurality of cutting elements 800 that may be similar to cutting elements 100, 200, 300, 400, 500, 600 shown and described with reference to FIGS. 2 through 8 or combinations thereof. The drill bit 850 may include a bit body 852 having a face 854 and generally radially extending blades 856, forming fluid courses 858 therebetween extending to junk slots 860 between circumferentially adjacent blades 856. Bit body 852 may comprise a metal or metal alloy, such as steel, or a particle-matrix composite material, as are known in the art.

Blades 856 may include a gage region 862 that is configured to define the outermost radius of the drill bit 850 and, thus, the radius of the wall surface of a bore hole drilled thereby. The gage regions 862 comprise longitudinally upward (as the drill bit 850 is oriented during use) extensions of blades 856.

The drill bit 850 may be provided with pockets 864 in blades 856, which may be configured to receive the cutting elements 800. The cutting elements 800 may be affixed within the pockets 864 on the blades 856 of drill bit 850 by way of brazing, welding, or as otherwise known in the art, and may be supported from behind by buttresses 866.

In some embodiments, portions of the blades 856 (e.g., portions of the blades 856 proximate cutting elements 800) may have inserts or coatings, secondary cutting elements, or wear-resistant pads, bricks, or studs, on outer surfaces thereof configured for wear in a manner similar to sections 810 of the cutting elements 800. In other words, portions of the blades 856 may be formed from a material or have elements attached thereto configured for wear at a similar rate as the sections 810 of the cutting elements 800 or configured for wear once one or more sections of the cutting elements 800 have been detached such that remaining sections 810 of the cutting element 800 (e.g., the sections 810 most proximate to blades 856) are enabled to engage the formation after a preceding section 810 has broken away. Stated in yet another way, portions of the drill bit 850 may be configured for wear such that the blades 856 will not substantially inhibit the sections 810 of the cutting elements 800 from engaging a formation.

Figure 12:
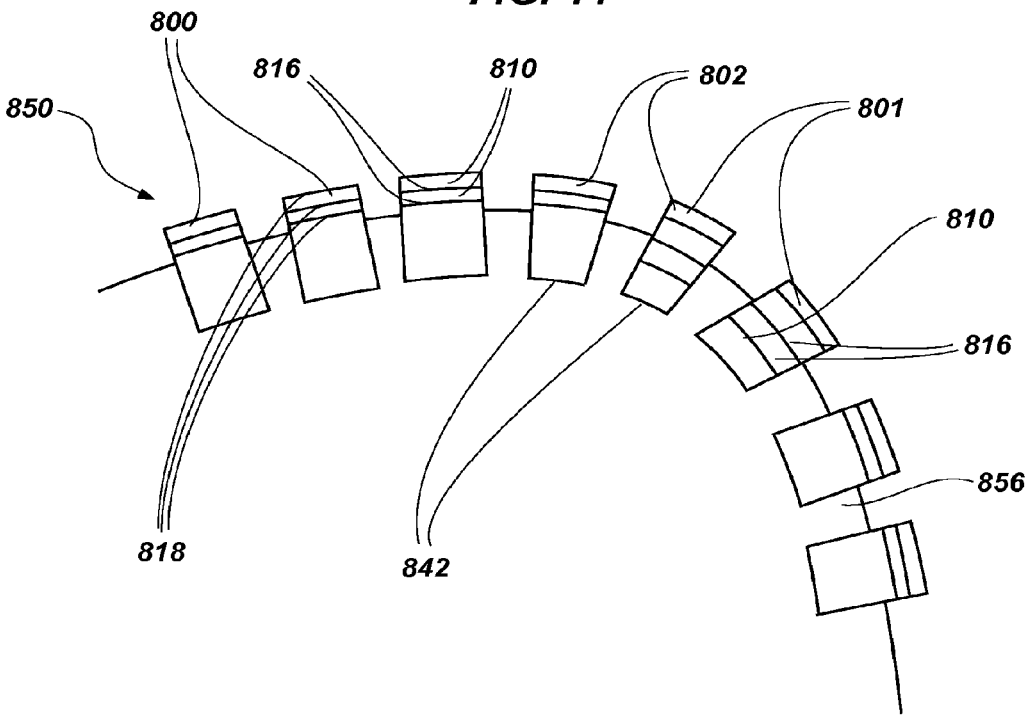
FIG. 12 is partial frontal view of the earth-boring tool shown in FIG. 11.

FIG. 12 is partial front view of a blade 856 of the drill bit 850 carrying a plurality of cutting elements 800. As shown in FIG. 12 and in some embodiments, recesses 816 formed in the cutting table 802 of the cutting element 800 may be formed to approximate the curvature (e.g., the blade profile) of the portion of the blade 856 to which the cutting element 800 is attached. Stated in another way, cutting edges 818 of the sections 810 of the cutting table 802 may be formed to exhibit a curvature substantially similar to the curvature of an outer surface of the blade 856 most proximate to the cutting element 800. In some embodiments, the cutting element 800 may include a tapered end 842 (e.g., at an end of the cutting element 800 most proximate to the fluid courses 858 (FIG. 11) of the drill bit 850). For example, the cutting elements 800 positioned at one or more regions of the blades 856 (e.g., the shoulder region) may include a tapered end 842 to enable desired spacing of the cutting elements 800 along the curvature of the blades 856.

In some embodiments and as shown by cutting elements 800, the recesses 816 may be formed to extend past an outer extent of the blades 856 at a rotationally leading side thereof. In such an embodiment, the cutting elements 800 extending past the blades 856 may be supported, for example, by the buttresses 866 (FIG. 11). In some embodiments and as shown by cutting elements 801, one or more recesses 816 may be positioned inside of an outer extent of the blades 856 at a rotationally leading side thereof. In such an embodiment, a section 810 of the cutting table 802 of the cutting elements 801 that does not extend past an outer extent of the blades 856 may engage a formation after a portion the blades 856 (e.g., the blades 856 of a steel bit body) have worn away, thereby, exposing the section 810 to the formation.

Although embodiments of the present disclosure have been described hereinabove with reference to cutting elements for earth-boring rotary drill bits, embodiments of the present disclosure may be used to form cutting elements for use with earth-boring tools and components thereof other than fixed-cutter rotary drill bits including, for example, other components of fixed-cutter rotary drill bits, roller cone bits, hybrid bits incorporating fixed cutters and rolling cutting structures, core bits, eccentric bits, bicenter bits, reamers, mills, and other such tools and structures known in the art.

Embodiments of the present disclosure may be particularly useful in forming cutting elements for earth-boring tools that provide more than one cutting edge for removing material of a formation. For example, a cutting element may initially engage the formation with a first section of the cutting element. After the section of the cutting element has experienced an amount of wear, the cutting element may be configured such that the first section may detach from the cutting element. The detachment of the first section will expose another section of the cutting element, which has experienced substantially less or no wear, for engagement with the formation. Stated in another way, through selective detachment of the sections of the cutting element, the cutting element may exhibit a so-called "self-sharpening" feature during a downhole operation.

While the present disclosure has been described herein with respect to certain embodiments, those of ordinary skill in the art will recognize and appreciate that it is not so limited. Rather, many additions, deletions and modifications to the described embodiments may be made without departing from the scope of the disclosure as hereinafter claimed, including legal equivalents. In addition, features from one embodiment may be combined with features of another embodiment while still being encompassed within the scope of the disclosure as contemplated by the inventors.

What is claimed is:

1. A method of selectively removing a portion of a cutting element of an earth-boring tool, the method comprising:

engaging a formation with a cutting surface of a first section of a cutting table of a cutting element;

detaching the first section of the cutting table as a substantial whole responsive to a mechanism other than wear at a discontinuity formed in the cutting table to at least partially expose a cutting surface of a second section of the cutting table adjacent to the first section; and engaging the formation with the cutting surface of the second section of the cutting table.

2. The method of claim 1, wherein detaching the first section of the cutting table at a discontinuity formed in the cutting table comprises detaching the first section of the cutting table at the discontinuity extending from a first portion of a peripheral edge of the cutting table to a second, opposing portion of the peripheral edge of the cutting table.

3. The method of claim 1, wherein detaching the first section of the cutting table at a discontinuity formed in the cutting table comprises detaching the first section of the cutting table responsive to a mechanism other than wear.

4. The method of claim 1, further comprising:

detaching the second section of the cutting table at another discontinuity formed in the cutting table to at least partially expose a cutting surface of a third section of the cutting table adjacent to the second section; and engaging the formation with the cutting surface of the third section of the cutting table.

5. The method of claim 1, wherein detaching the first section of the cutting table comprises removing the first section from a substrate to which the first section was attached.

6. The method of claim 5, further comprising separating the first section from the second section at at least one protrusion of the substrate extending into a portion of the cutting table extending between the first section and the second section.

7. The method of claim 1, further comprising separating the first section from the second section at a recess extending between the first section and the second section.

8. The method of claim 1, further comprising separating the first section from the second section at at least one variation in a property of material forming the cutting table positioned between the first section and the second section.

9. The method of claim 1, wherein engaging the formation with the cutting surface of the first section of the cutting table of the cutting element comprises contacting the formation with a leading portion of an elongated cutting surface of the cutting table.

10. A method of selectively removing a portion of a cutting element of an earth-boring tool, the method comprising:

engaging a formation with a cutting table comprising a plurality of adjacent sections attached to a substrate;

separating a leading section of the plurality of adjacent sections from the substrate at at least one discontinuity in the cutting table extending across the cutting table defining the plurality of adjacent sections; and exposing a leading edge of a trailing section of the plurality of adjacent sections upon detachment of the leading section.

11. The method of claim 10, further comprising splitting the leading section from the trailing section at the at least one discontinuity that extends from a first peripheral side of the cutting table to a second, opposing peripheral side of the cutting table.

12. The method of claim 10, further comprising detaching the leading section of the cutting table from a substrate along an interface between the cutting table and the substrate.

13. The method of claim 12, further comprising detaching the leading section of the cutting table from a substrate along at least one discontinuity at the interface between the cutting table and the substrate, the at least one discontinuity comprising at least one of at least one protrusion of the substrate extending into a portion of the cutting table, at least one recess formed in the cutting table at the interface between the cutting table and the substrate, and at least one variation in a property of material forming the cutting table at the interface between the cutting table and the substrate.

14. The method of claim 10, further comprising splitting the leading section from the trailing section at a recess in the cutting table extending across a cutting surface of the cutting table.

15. The method of claim 10, further comprising detaching the leading section as a substantial whole responsive to a mechanism other than wear during a downhole operation.

16. The method of claim 10, further comprising detaching the leading section while remaining sections of the plurality of adjacent sections remain intact.

17. A method of selectively removing a portion of a cutting element of an earth-boring tool, the method comprising:

engaging a formation with a cutting surface of a first section of a cutting table of a cutting element; and detaching the first section of the cutting table as a substantial whole during a downhole operation to at least partially expose a cutting surface of a second section of the cutting table adjacent to the first section.

18. The method of claim 17, further comprising engaging the formation with the cutting surface of the second section of the cutting table.

19. The method of claim 17, further comprising detaching the first section of the cutting table while the remaining sections of the cutting table remain intact.

20. The method of claim 17, further comprising detaching the first section of the cutting table responsive to a mechanism other than wear.

* * * * *